US010633956B2

(12) United States Patent
Vachon

(10) Patent No.: US 10,633,956 B2
(45) Date of Patent: Apr. 28, 2020

(54) DUAL TYPE INFLOW CONTROL DEVICES

(71) Applicant: CONOCOPHILLIPS COMPANY, Houston, TX (US)

(72) Inventor: Guy Vachon, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 15/184,747

(22) Filed: Jun. 16, 2016

(65) Prior Publication Data

US 2016/0369591 A1 Dec. 22, 2016

Related U.S. Application Data

(60) Provisional application No. 62/180,434, filed on Jun. 16, 2015.

(51) Int. Cl.
*E21B 43/12* (2006.01)

(52) U.S. Cl.
CPC ..... *E21B 43/12* (2013.01)

(58) Field of Classification Search
CPC ..... E21B 43/12
See application file for complete search history.

(56) References Cited

U.S. PATENT DOCUMENTS 8,469,105 B2 6/2013 O'Malley et al.
8,469,106 B2 6/2013 O'Malley
8,527,100 B2 9/2013 Russell et al.
10,000,996 B2 * 6/2018 Russell ..... E21B 34/08
2009/0229824 A1 * 9/2009 Ocalan ..... E21B 34/066 166/303
2013/0213652 A1 8/2013 Stalder
2014/0209297 A1 7/2014 Halliburton
2015/0013980 A1 * 1/2015 Duphorne ..... E21B 43/088 166/276
2015/0034334 A1 2/2015 Hallundbaek et al.
2015/0053419 A1 2/2015 Garcia et al.

OTHER PUBLICATIONS

International Search Report for parent case, App. No. PCT/US2016/037920, dated Oct. 28, 2016.
Zeng Q. et al., Tech Science Press SL 9(3): 169-180 (2013).
SPE-153706 (2012) Stalder, Test of SAGD Flow Distribution Control Liner System, Surmont Field, Alberta, Canada.
Torbergsen, H. B, 2010, "Application and Design of Passive Inflow Control Devices on the Eni Goliat Oil Producer Wells," Masters Thesis, University of Stavanger.

* cited by examiner

*Primary Examiner* — Catherine Loikith
(74) *Attorney, Agent, or Firm* — Boulware & Valoir

(57) ABSTRACT

Inflow control devices that can be used for both viscous and less viscous hydrocarbons. Optimized configurations for passive inflow control devices or ICDs having two types of fluidic pathways are combined in the same device or well in series or in parallel. Also provided, are well configurations that can be used for e.g., steam assisted oil recovery methods, wherein steam flashing is prevented by included dual type passive inflow control devices in the completion.

12 Claims, 9 Drawing Sheets

$$\Delta P = \frac{128 \mu L Q}{\pi d^4} \propto \mu Q$$

$$\Delta P \propto a_2 Re^{b_2} + \frac{(a_1 Re^{b_1} + a_2 Re^{b_2})}{(1 + (\frac{Re}{t})^c)^d}$$

HELICAL > HYBRID IN SERIES

HYBRID > HELICAL IN SERIES

HELICAL AND HYBRID IN PARALLEL

DUAL TYPE INFLOW CONTROL DEVICES

PRIORITY CLAIM

This application is a non-provisional application which claims benefit under 35 USC § 119(e) to U.S. Provisional Application Ser. No. 62/180,434 filed Jun. 16, 2015, entitled "DUAL TYPE ICD," which is incorporated herein in its entirety.

FEDERALLY SPONSORED RESEARCH STATEMENT

Not Applicable.

REFERENCE TO MICROFICHE APPENDIX

Not applicable.

FIELD OF THE DISCLOSURE

This disclosure relates generally to optimized configurations for inflow control devices that can be used for both viscous and less viscous hydrocarbons.

BACKGROUND OF THE DISCLOSURE

In long horizontal wells, the production rate at the heel is often higher than that at the toe. The resulting imbalanced production profile may cause early water or gas breakthrough into the wellbore. Once coning occurs, well production may severely decrease due to limited flow contribution from the toe. To eliminate this imbalance, inflow control devices (ICDs) are placed in each screen joint to balance the production influx profile across the entire lateral length and to compensate for permeability variations.

By restraining, or normalizing, flow through high flow rate sections, ICDs create higher drawdown pressures and thus higher flow rates along the borehole sections that are more resistant to flow. This corrects uneven flow caused by the heel-toe effect and heterogeneous permeability.

Although they are called inflow control devices, ICDs are also used to manage fluid outflow in injection wells. In some cases, modeling reveals that it is more effective to place ICDs in the injector well than in the producer. In many cases, installing the devices in both the injector and producer wells may be the best option.

Stalder investigated the flow distribution control of ICDs. Based on the observation of an ICD-deployed SAGD well pair in a Surmont SAGD operation, he came to the conclusion that an ICD -deployed single tubing completion achieved similar or better steam conformance as compared to the standard toe/heel tubing injection. In addition, the ICD completion significantly reduced tubing size, which in turn reduced the size of slotted liner, intermediate casing, and surface casing. The smaller wellbore size increased directional drilling flexibility and reduced drag making it easier and lower cost to drill the wells. Thus, wells can be drilled much longer than current SAGD wells, which tend to be between 500 and 1000 m.

Indeed, ICDs have been installed in hundreds of wells during the last decade, being now considered to be a mature, well completion technology. Steady-state performance of ICDs can be analyzed in detail with well modeling software. Most reservoir simulators include basic functionality for ICD modeling.

Currently, there are four primary types of passive ICD designs in the industry: nozzle-based (restrictive) (FIG. 1), helical channel (frictional) (FIG. 2), tube-type (combination of restrictive and friction) (FIG. 3) and hybrid channel (combination of restrictive, some friction and a tortuous pathway) (FIG. 4). They use four different methods to generate a pressure drop.

The nozzle-based ICD uses fluid constriction to generate an instantaneous differential pressure across the device by forcing the fluid from a larger area down through small diameter port, creating a flow resistance. The benefits of nozzle-based ICD are its simplified design and easier nozzle adjustment immediately before deployment in a well should real-time data indicate the need to change flow resistance. The disadvantage of nozzles are the small diameter ports required to create flow resistance, which also make them prone to both erosion from high-velocity fluid-borne particles during production, and susceptible to plugging, especially during any period where mud flow back occurs.

The helical channel ICD uses surface friction to generate a differential pressure across the device. The helical channel design is one or more flow channels that wrapped around the base pipe. This design provides for a distributed pressure drop over a relatively long area, versus the instantaneous loss using a nozzle. Because the larger cross-sectional flow area of the helical channel ICD generates significantly lower fluid velocity than the nozzles of a nozzle-based ICD with a same FRR, the helical channel ICD is more resistance to erosion from fluid-borne particles and resistant to plugging during mud flow back operations. The disadvantage of helical-channel ICD is its flow resistance is more viscosity-dependent than the nozzle-based ICD, thus start up is delayed. The cost of delayed production has been estimated at $2M/month (the figure assumes no production for a month). The viscosity dependence could also allow preferential water flow should premature water breakthrough occur. Also, the helix ICD is not adjustable.

The tube-type ICD design incorporates a series of tubes. The primary pressure drop mechanism is restrictive, but in long tubes. This method essentially forces the fluid from a larger area down through the long tubes, creating a flow resistance. Because of the additional friction resistance, the larger cross-sectional flow area of the tube-type ICD generates lower fluid velocity than the nozzles of a nozzle-based ICD with a same FRR, the tube-type ICD is more resistance to erosion from fluid-borne particles and resistant to plugging during mud flow back operations. However, since the friction resistance is much less than the local resistance, the tube-type ICD is less viscosity-dependent than the helical channel ICD with a same FRR.

The hybrid ICD design incorporates a series of flow slots in a maze pattern. Its primary pressure drop mechanism is restrictive, but in a distributive configuration. A series of bulkheads are incorporated in the design, each of which has one or more flow cuts at an even angular spacing. Each set of flow slots are staggered with the next set of slots with a phase angle thus the flow must turn after passing through each set of slots. This prevents any jetting effect on the flow path of the downstream set of slots, which may induce turbulence. As the production flow passes each successive chamber that is formed by bulkheads, a pressure drop is incurred. Pressure is reduced sequentially as the flow passes through each section of the ICD. Without the need to generate the pressure drop instantaneously, the flow areas through the slots are relatively large when compared to the nozzle design of same FRR, thus dramatically reducing erosion and plugging potential.

In addition to these basic flow patterns and pressure drop mechanisms, the commercially available ICDs include other desirable features, such as sand screens. See e.g., the Equalizer and the Equalizer Select, both from Baker Hughes (FIG. 5). The Equalizer uses a helical flow-type design, whereas the Equalizer Select, in contrast, uses a hybrid type design that incorporates a series of flow chambers, each containing a restriction. As the production flows through each successive chamber, pressure is reduced sequentially. Each set of flow slots is staggered, so flow must turn after passing through each chamber, and this configuration minimizes jetting effects. Flow area through the slots is larger than openings in analogous orifice ICDs, so the potential for plugging and erosion is dramatically reduced. Furthermore, this device is adjustable by rotating the overlying tube or sleeve so as to open or close the various channels. As used herein, this specific pattern of a plurality of different length flow pathways, each having large flow chambers with staggered slots and an adjustable sleeve to control which length flow pathway is used is known as the "select" pattern, and it is a variation on a hybrid pattern.

Recently a new type of ICD called an autonomous ICD or AICD was developed. See US20140209297. In this ICD, the flow is vortex shaped, with shortcuts to the center (FIG. 7). The vortex has two intake on separate sides and a port to the inner tube in the center. Oil, which is thicker, takes the shorter route via the shortcuts and thus experiences less pressure drop and a faster rate of production. Water, which is much thinner, takes the longer route, spiraling all the way to the center, with much greater pressure drop and thus less water is produced.

Although all ICD's offer benefit, the reality is that none of these ICDs alone meets the ideal requirements of an ICD designed for the life of the well: high resistance to plugging and erosion, high viscosity insensitivity, and yet at the same time allows for flow control of the more complex flow profiles from enhanced oil recovery methods, such as SAGD where oil viscosity is higher during startup, where temperatures have not yet reached a high, and viscosity reduces as the temperature increases. Therefore, the selection and optimization of ICDs for specific reservoirs, especially heavy oil reservoirs, is still needed in the art.

SUMMARY OF THE DISCLOSURE

We have performed modeling studies of the various types of ICD and varied such parameters as temperature, steam quality, differential pressure and the like.

As a result of our studies, we discovered the temperature sensitivity of the steam block effect. Although unexpected, this is consistent with the physics of the ICD because the saturation pressure is higher and thus density is higher, which causes steam volume flow to be less and hence ΔP to be less. We also found that higher resistance rating FCDs exhibit improved steam block behavior relative to less restrictive devices of the same architecture. This was not anticipated, but again consistent with the underlying physics. More ΔP means more steam is liberated as the pressure falls further below saturation. The extra steam in turn produces more ΔP. Once the effect is initiated, it builds on itself. A corollary to this finding is that deficiency in steam block for one architecture can be overcome by utilizing more restrictive devices.

In comparing helical channel and hybrid ICDs, they have both advantages and disadvantages when applied to SAGD. The helical channel is very resistive to flow at high viscosity and thus will hamper the start-up of SAGD wells. The hybrid is insensitive to viscosity and thus will not resist flow of high viscosity fluids during startup. However, it is less effective at blocking steam. The helical channel is very reactive to increases in flow or to the presence of steam so it will steam block and enforce conformance more effectively than hybrid channel ICD. The optimal configuration can thus vary, especially in SAGD and other steam based enhanced oil recovery operations where steam breakthrough is an issue and where the flow parameters change over time.

Our solution to developing an ideal ICD for enhanced recovery technologies, such as SAGD, is to combine two types of geometries so as to deliver optimal performance for startup (where hybrid is much better), for increasing fluid flow without phase transitions (where helix is a better), and for steam blocking (where helix is much better). The optimal ICD thus is dual natured, having both a helical path and a hybrid type maze. The two different pathway types can be combined in different ways:

- In series where the dP of both elements adds. These can be combined in the same ICD, or in alternating ICDs.
- In parallel where the fluids distribute themselves according to relative restriction (effectively fluids preferentially travel the least restrictive path).
- In parallel with a temperature sensitive switch that routes to a select type maze while fluid is cold during startup and routes to a helix as the production fluids approach operating temperature.

Arrangements for the dual-type ICD thus include the following, where "H" is helix, "S" is select or any other restrictive flow or hybrid channel type pattern, "i" is the intake, "o" is the port to the i and "T" represents a temperature sensitive switch:

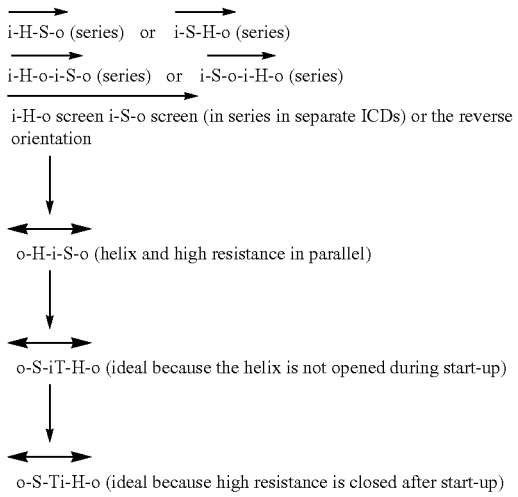

There are hybrid ICD designs already in the art (see e.g., FIG. 4 and 5). However, in these designs, two types of flow control methods are blended such that one achieves a blended result.

In contrast, we have designed herein a dual pattern ICD that can be switched from one type of geometry to the other type of geometry based on well conditions. The switching can be autonomous, based on selecting the least path of least resistance, or can be controlled, e.g. with a thermal switch.

In the designs presented herein, the helical flow and the hybrid flow geometries are presented in series (FIG. 8A-B) or parallel (FIG. 9), and thus one can use one or the other pathway according to need.

Alternatively, a temperature sensitive switch controls which pathway is taken, an embodiment of which is illustrated in FIG. 10. Exemplary switches that could be used for this include any mechanical switch type, such as bimetallic strip or disc switches, where differential expansion of the two metals causes the strip or disc to bend, thus controlling the device. Humidity switches, fluid thermal expansion temperature switches, wax-pellet thermostat, and flow switches may also provide useful switch options.

An exemplary thermal switch may consist of materials with different coefficients of expansion so as temperature goes up, the faster expanding material blocks the path of the fluid in one instance or opens the path to the fluid in another. A sealed gas chamber attached to a piston where the piston opens and closes a valve would do this well.

In one embodiment, the switch can either be selected or designed to direct flow to the hybrid path and away from the helical pathway which is closed during SAGD startup. Once the steam chamber is fully developed, and the temperature risen sufficiently, the switch will change over to direct flow to the helical pathway, with the hybrid pathway being closed. The helix will effectively close itself during startup. A switch that closes as temperature goes up would be used to block flow through the Select.

Of course the dual-type ICDs of the disclosure can be combined with other features or accessories typically used with ICDs, such as sliding sleeves, sand screens, packers and the like.

The invention also includes methods of using the dual ICDs, well configurations containing same, and the like.

The invention can comprise any one or more of the following embodiments, in any combination(s) thereof:

A dual type inflow control device (dual-type ICD), comprising: a) a tube and sleeve fitting over the tube, the sleeve having at least one inlet, and the tube having at least one outlet to an interior of the tube; b) an annulus between the tube and the sleeve having a fluidic pathway therein from the inlet to the outlet, the fluidic pathway having first a first pattern and a second pattern different from the first pattern, the first and second patterns being fluidly connected in series or in parallel.

A dual-type ICD as herein described, where the first pattern is helical channel and the second pattern is tube or hybrid channel.

A dual-type ICD as herein described, where the first pattern is helical channel and the second pattern is hybrid channel and wherein the helical channel fluidic pathway is optimized for a production phase of steam assisted gravity drainage (SAGD) and the hybrid channel fluidic pathway is optimized for a startup phase of SAGD.

A dual-type ICD as herein described, where the first and second patterns are arranged in series, and the first pattern is helical channel and the second pattern is tube or hybrid channel.

A dual-type ICD as herein described, where the first and second patterns are arranged in parallel, and the first pattern is helical channel and the second pattern is hybrid channel.

A dual-type ICD as herein described, where the first and second patterns are arranged in series, and the first pattern is helical and the second pattern is hybrid channel and wherein the helical channel fluidic pathway is optimized for a production phase of SAGD and the hybrid channel fluidic pathway is optimized for a startup phase of SAGD.

A dual-type ICD as herein described, wherein the first and second patterns are arranged in series and flow through the first and second patterns is controlled with a temperature sensitive switch.

A dual-type ICD as herein described, wherein the first and second patterns are arranged in series and flow through the first and second patterns is controlled with a temperature sensitive switch and wherein the first pattern is helical channel and is optimized for a production phase of SAGD and wherein the second pattern is hybrid channel and is optimized for a startup phase of SAGD.

A dual-type ICD as herein described, where the first pattern is helical channel and the second pattern is a hybrid channel, wherein the first and second patterns are arranged in series and flow through the first and second patterns is controlled with a temperature sensitive switch.

A dual-type ICD as herein described, where the first pattern is helical channel and the second pattern is a hybrid channel, wherein the first and second patterns are arranged in series and flow through the first and second patterns is controlled with a temperature sensitive switch and wherein the helical channel is optimized for a production phase of SAGD and wherein the hybrid channel is optimized for a startup phase of SAGD.

A dual-type ICD as herein described, where the first and second patterns are arranged in parallel, and the first pattern is helical and the second pattern is hybrid channel and wherein the helical channel fluidic pathway is optimized for a production phase of SAGD and the hybrid channel fluidic pathway is optimized for a startup phase of SAGD.

A dual-type ICD as herein described, wherein the first and second patterns are arranged in parallel and flow through the first and second patterns is controlled with a temperature sensitive switch.

A dual-type ICD as herein described, wherein the first and second patterns are arranged in parallel and flow through the first and second patterns is controlled with a temperature sensitive switch and wherein the first pattern is helical channel and is optimized for a production phase of SAGD and wherein the second pattern is hybrid channel and is optimized for a startup phase of SAGD.

A dual-type ICD as herein described, where the first pattern is helical channel and the second pattern is a hybrid channel, wherein the first and second patterns are arranged in parallel and flow through the first and second patterns is controlled with a temperature sensitive switch.

A dual-type ICD as herein described, where the first pattern is helical channel and the second pattern is a hybrid channel, wherein the first and second patterns are arranged in parallel and flow through the first and second patterns is controlled with a temperature sensitive switch and wherein the helical channel is optimized for a production phase of SAGD and wherein the hybrid channel is optimized for a startup phase of SAGD.

A well configuration, comprising a well completed with alternating ICD types.

A well configuration, comprising a well completed with a plurality of the dual-type ICDs described herein.

A well configuration as described herein, wherein the well is a horizontal well.

A well configuration as described herein, comprising a well completed with alternating helical channel ICDs and hybrid channel ICDs.

A method of SAGD comprising: a) providing a horizontal injection well above a horizontal production well, one or both wells completed with a dual type ICD; b) injecting steam into the injection well; and c) recovering mobilized oil from the production well.

A method of SAGD comprising: a) providing a horizontal injection well above a horizontal production well, one or both wells completed with a plurality of dual type ICDs; b) injecting steam into the injection well; c) recovering mobilized oil from the production well via the hybrid channel fluidic pathway during start up; and d) recovering mobilized oil from the production well via the helical channel fluidic pathway after start up.

An improved method of producing heavy oils by SAGD, wherein steam is injected into an upper horizontal well to mobilize oil which gravity drains to a lower horizontal well and flow is controlled in one or both wells with a plurality of ICDs, the improvement comprising providing a plurality of dual-type ICDs in one or both horizontal wells, thus improving a CSOR of the lower horizontal well as compared to the same one or both wells with only single type of ICD.

An improved method of producing heavy oils by SAGD, wherein steam is injected into an upper horizontal well to mobilize oil which gravity drains to a lower horizontal well and flow is controlled in one or both wells with a plurality of ICDs, the improvement comprising providing alternating type ICDs in one or both horizontal wells, thus improving a CSOR of the lower horizontal well as compared to the same one or both wells with only single type of ICD.

An improved method of producing heavy oils by a steam based enhanced oil recovery method, wherein steam is injected into an well to mobilize oil and flow is controlled in the well with a plurality of ICDs, the improvement comprising providing a plurality of dual-type ICDs in the well, thus improving a CSOR of the well as compared to the same well with only single type ICDs.

A method as herein described, further comprising recovering mobilized oil from the production well mostly via the hybrid channel fluidic pathway during start-up; and recovering mobilized oil from the production well mostly via the helical channel fluidic pathway after start-up.

By "inflow control devices" or "ICDs," also known as "passive ICDS" or "PICDs," what is meant is a well completion device that restricts the fluid flow from the annulus into the base pipe. The restriction can be in form of channels or nozzles/orifices or combinations thereof, but in any case the ability of an ICD to equalize the inflow along the well length is due to the difference in the physical laws governing fluid flow in the reservoir and through the ICD. By restraining, or normalizing, flow through high-rate sections, ICDs create higher drawdown pressures and thus higher flow rates along the bore-hole sections that are more resistant to flow. This corrects uneven flow caused by the heel-toe effect and heterogeneous permeability. The ICDS described herein can be used for inflow or outflow control.

By "dual type" ICDs, what is meant is an ICD that has two types of flow restriction pathways that are not blended, but independent or separate, such that the device can take the advantage of the different types of restriction pathways at different times. Preferably, the dual type ICD has both helical and hybrid flow restriction pathways, preferably in parallel and optionally with a temperature switch controlling flow between the two.

Multiple inflow control devices can be installed along the reservoir section of the completion, with each device employing a specific setting to partially choke flow. The resulting arrangement can be used to delay water or gas breakthrough by reducing annular velocity across a selected interval such as the heel of a horizontal well. ICDs are frequently used with sand screens on openhole completions.

By "providing" a well, we mean to either drill a well or use an existing well. The term does not necessarily imply contemporaneous drilling because an existing well can be retrofitted for use or used as is.

By being "fitted" for injection or production what we mean is that the completion has everything that is needs in terms of equipment needed for injection or production. By being fitted with ICDs, a well is completed with ICDS pre-adjusted for use at a particular location and everything is provided for their functionality.

"Vertical" drilling is the traditional type of drilling in oil and gas drilling industry, and includes any well <45° of vertical.

"Horizontal" drilling is the same as vertical drilling until the "kickoff point" which is located just above the target oil or gas reservoir (pay-zone), from that point deviating the drilling direction from the vertical to horizontal. By "horizontal" what is included is an angle within 45° (≤45°) of horizontal. Of course every horizontal well has a vertical portion to reach the surface, but this is conventional, understood, and typically not discussed.

By "slotted liner" or "slotted pipe" what is meant is a joint fitted with slots for production or injection uses. A "perforated liner" or "perforated pipe" is similar, the perforations are typically round, instead of long and narrowed as in a slotted liner. Many slotted or perforated joint includes end sections that are not slotted or perforated, but this is conventional, understood, and typically not discussed.

A "blank pipe" or "blank liner" is a joint that lacks any holes.

A "joint" is a single section of pipe.

As used herein a "tubular" is a generic term pertaining to any type of oilfield pipe, such as drill pipe, drill collars, pup joints, casing, production tubing and pipeline.

As used herein a "tubing string" refers to a number of joints that are joined end to end to reach don into a well.

By a "start-up" phase what is meant is the preheat phase of SAGD wherein all wells are fitted for steam injection, and steam injection proceeds in all wells until the wells are in fluid communication and a steam chamber is established. This is typically followed by a "production phase" wherein the (usually lower) production wells are fitted for production, and steam injection occurs only in the (usually upper) injection wells.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| | |
|---|---|
| bbl | Oil barrel, bbls is plural |
| CSOR | Cumulative Steam to oil ratio |
| CSS | Cyclic steam stimulation |
| ES-SAGD | Expanding solvent-SAGD |
| FCD | Flow control device |
| FRR | Flow resistance rating |
| ICD | Inflow control device-a passive inflow control device that functions via restricting fluid flow, also PICD |
| OOIP | Original Oil in Place |
| SAGD | Steam assisted gravity Drainage |
| SD | Steam drive |
| SOR | Steam to oil ratio |

BRIEF DESCRIPTION OF THE DRAWINGS

A more complete understanding of the present invention and benefits thereof may be acquired by referring to the follow description taken in conjunction with the accompanying drawings in which:

FIG. 8C shows an alternating helical ICD and hybrid ICD well configuration.

DESCRIPTION OF EMBODIMENTS

Figure 8A:
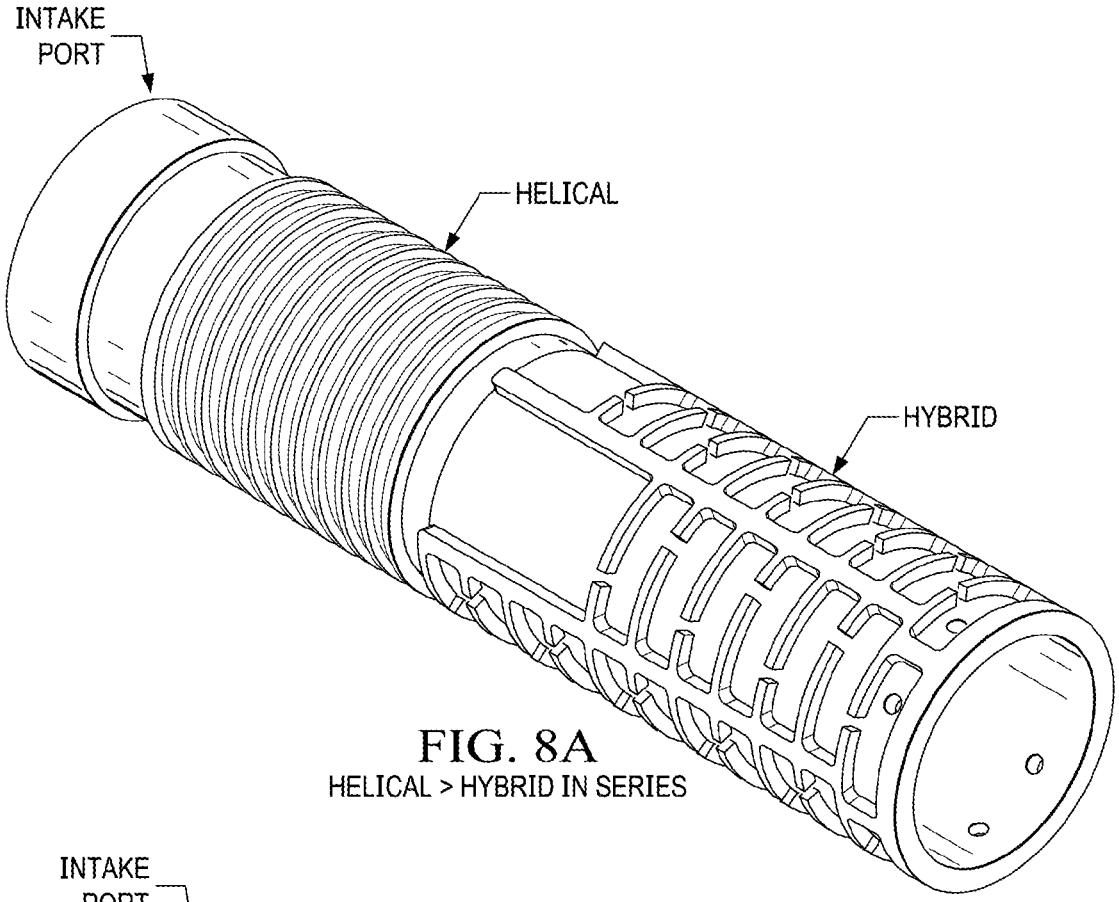
FIG. 8A shows one embodiment of a helical-hybrid series design.
Figure 8B:
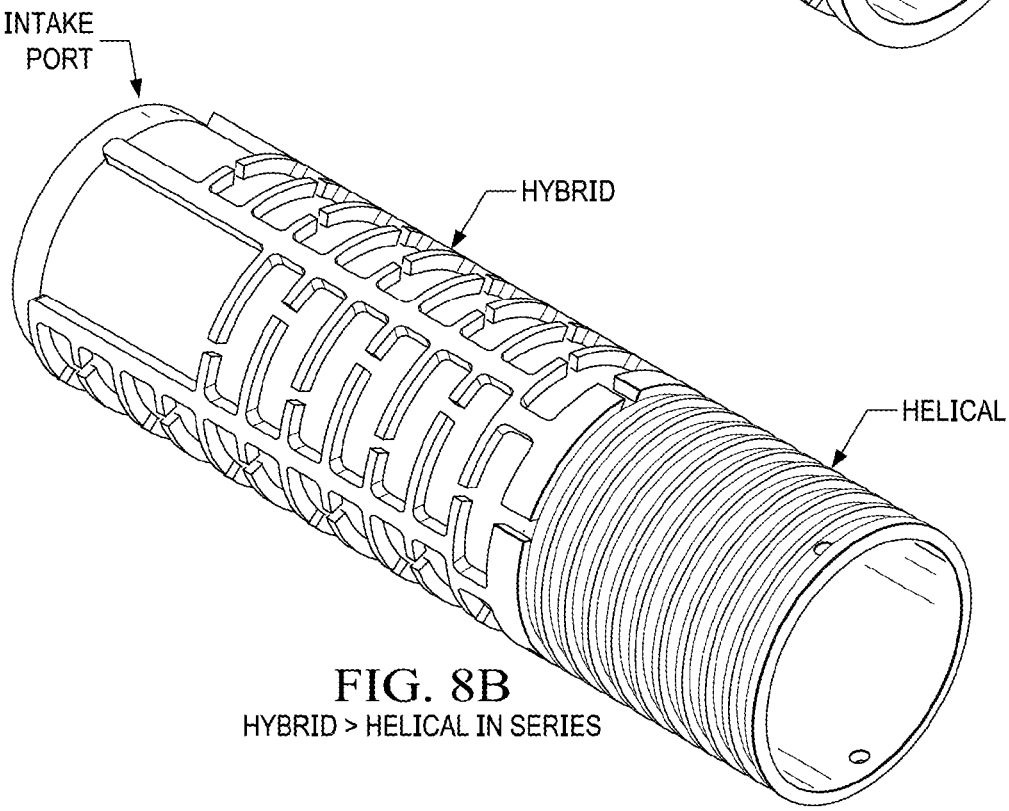
FIG. 8B shows another embodiment of a helical-hybrid series design.

The present disclosure provides novel ICD configurations wherein two different types of fluidic pathway are used in the same design or well completion, without being blended or merged. For example, helical and hybrid type ICD designs are both used in the same ICD in separation locations or are alternated in a well. This is quite different from the existing hybrid design, which blends the features from two types of ICD. Instead, it is a dual-nature ICD, each separate flow restriction pattern or pathway functioning as intended. The path taken by fluid will depend on its e.g., viscosity—viscous fluids preferentially traveling through the hybrid portion of the ICD, and low viscosity fluids will preferentially travel the helix. FIGS. 8A and 8B show a helix in series with a high resistance hybrid, which is a type of hybrid ICD pattern. In FIG. 8A, the helix precedes the Select, and in FIG. 8B, the order is reversed. FIG. 8C shows a typical well completion, but where two types of ICD alternate on completion. Thus, helical ICDs 7, 9, 11, 13, 15, 17, 19, 21, 25, 27, 29, 31 alternate with hybrid or Select ICDs 6, 8, 10, 12, 16, 18, 20, 22, 24, 26, 28, 30. The completion is otherwise typical, and shows tubing joint blank pipe 4, oil swellable packers 5, 14, 23, 32, tubing joints may replace a pair of ICDs such as the ICDs at 12 and 13, 21 and 22, or 30 and 31, slotted tubing joint 33, BTC pin 34 (BTC is a type of thread—buttress thread casing), Stinger seal receptacle 35, BTC spacer joint 36, BTC wash down shoe 37.

Figure 9:
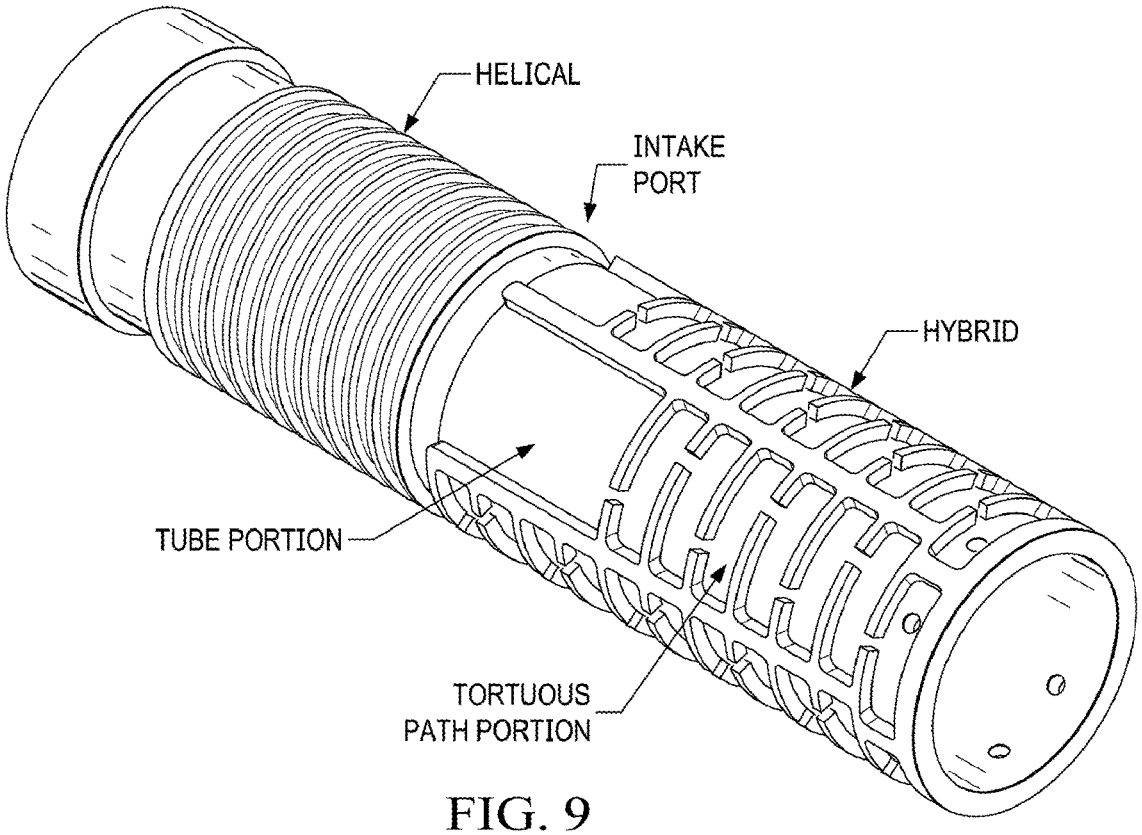
FIG. 9 shows one embodiment of a helical-hybrid parallel design.

FIG. 9 shows a helix in parallel with a high resistance Select. Here, in order to run the two flow patterns in parallel, the intake is between the two fluidic pathway types, and fluid can travel either or both paths at once. In this type of design:

- When viscosity is high there is high resistance on the helix and low on the Select, thus the flow will bypass the helix and go through the Select.
- When viscosity is low, but there is no flashing, the flow will bypass the high resistance Select through the helix.
- When there is steam flashing the helix blocks because it has great steam block and the Select blocks because it has high resistance to begin with.

The overall result is better than the helix at high viscosity (start up) though not as good as low resistance Select, it is as good as the helix in low viscosity without flashing and exhibits almost the same steam block as helix when flashing occurs. In one embodiment, nested helices may be used to allow multiple temperature selectivity.

Figure 10:
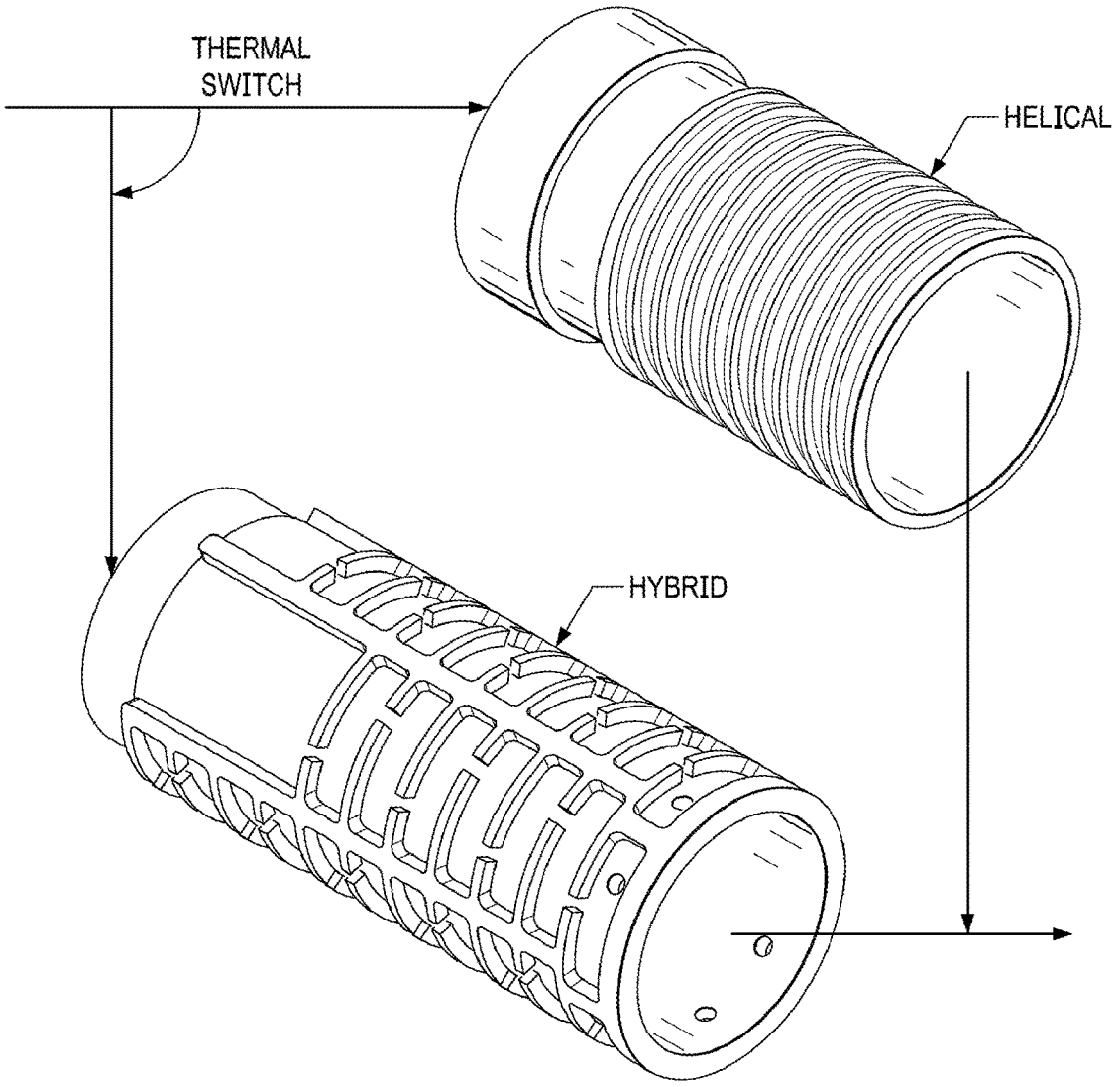
FIG. 10 shows the temperature sensitive switching from the helical to the hybrid designs. In this instance, the helix and hybrid are in series and the temperature switch between them. Oil entering the ICD will be routed to one path or the other based on the temperature. In this way, early production will use the helix, and later higher temperature production will use the hybrid type ICD.

The effect can be further improved by including a temperature sensitive switch in the design. FIG. 10. With the switch, the helical pathway is blocked during startup and 100% of the flow is through the hybrid pathway.

Figure 1:
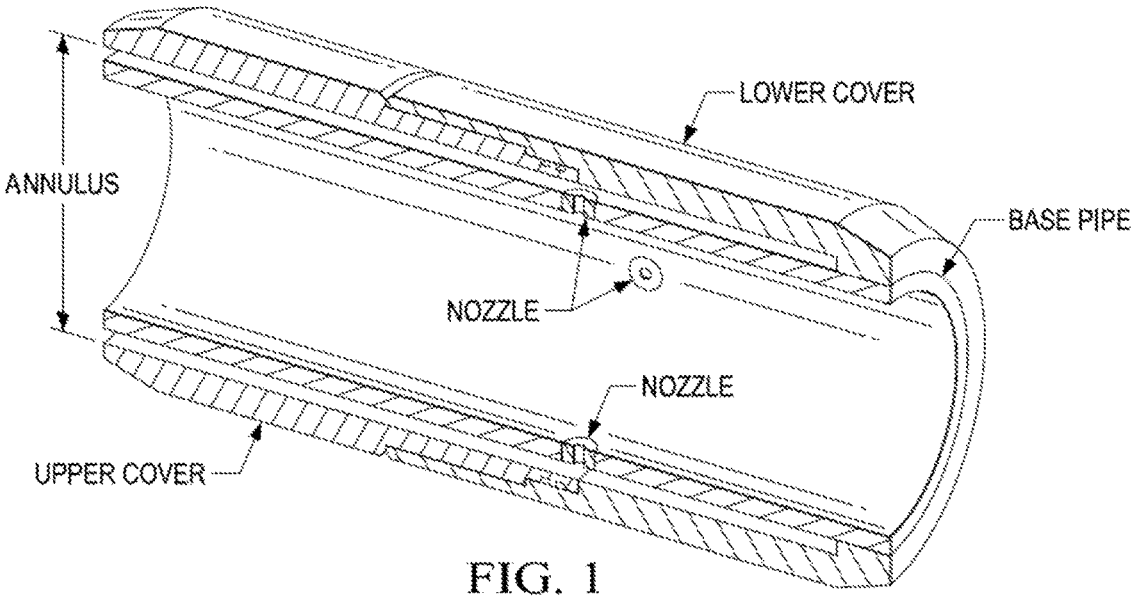
FIG. 1 (PRIOR ART)
FIG. 1 shows a nozzle-type ICD.
Figure 2:
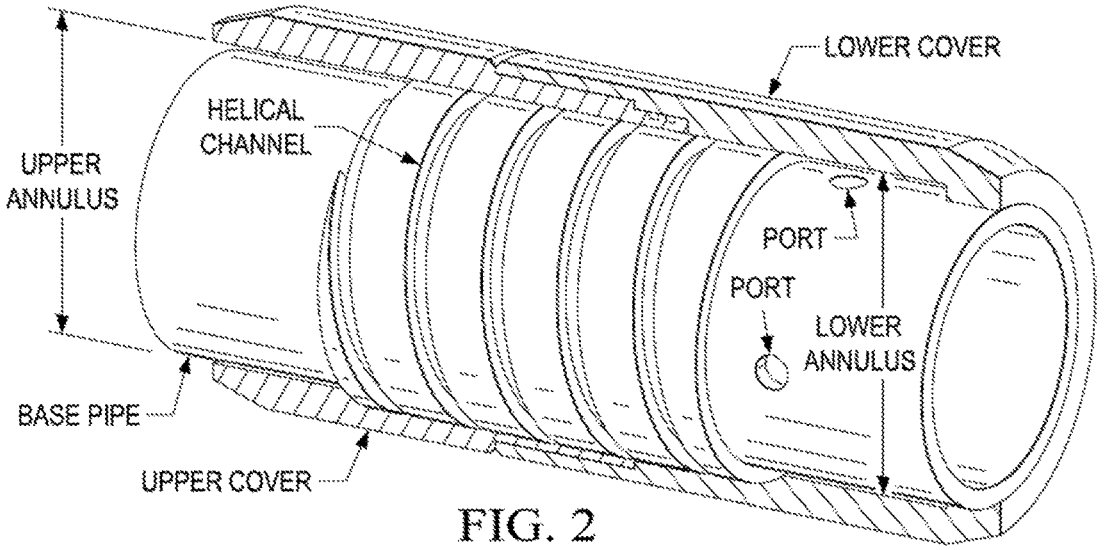
FIG. 2 (PRIOR ART)
FIG. 2 shows a helical pathway-type ICD.
Figure 3:
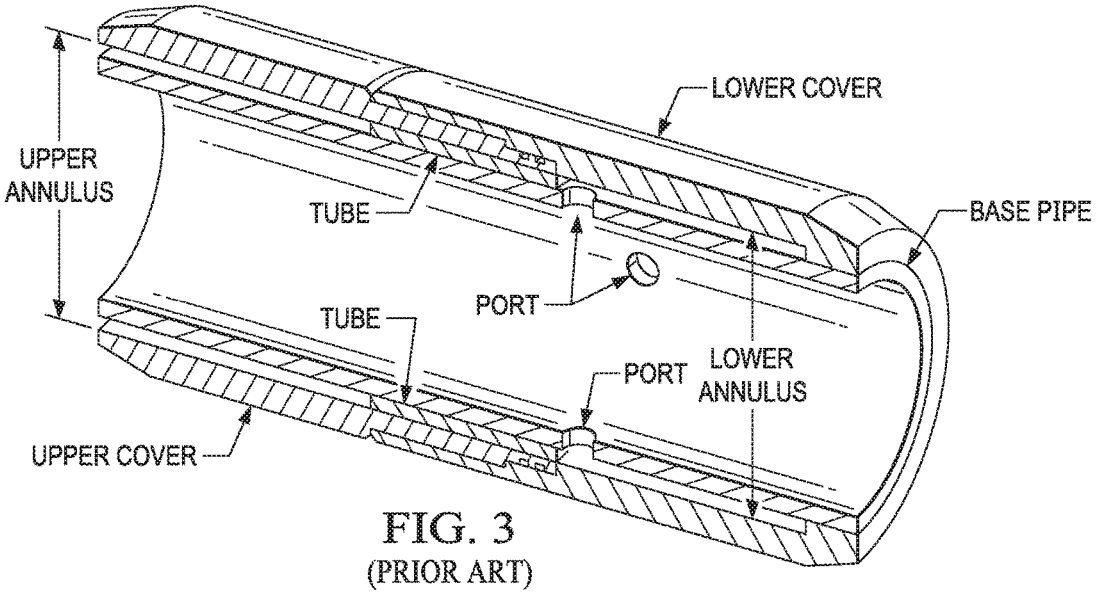
FIG. 3 (PRIOR ART)
FIG. 3 shows a tube-type ICD.
Figure 4:
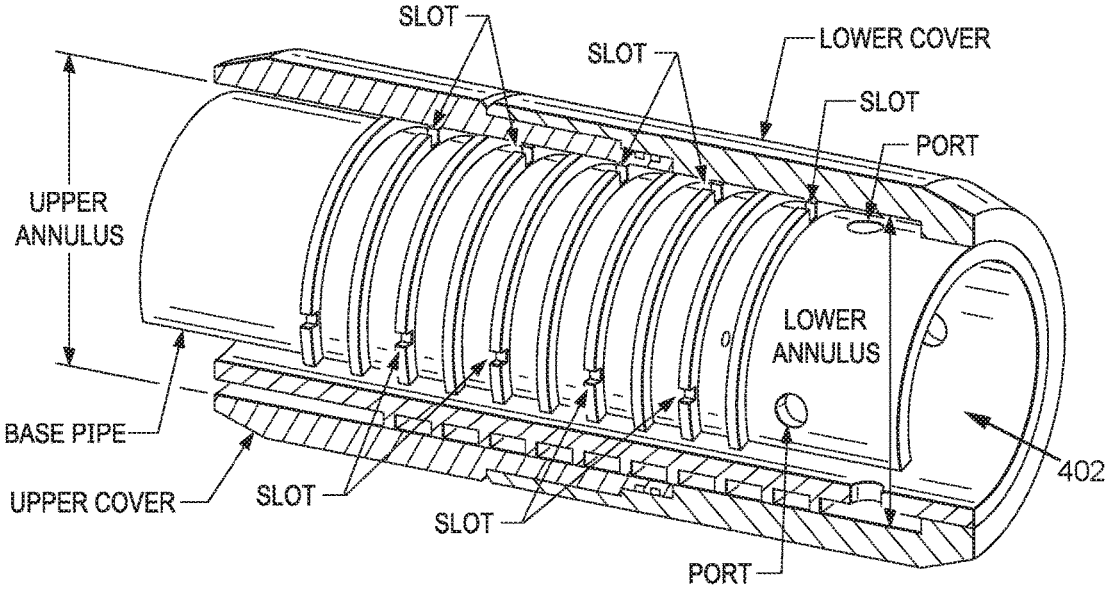
FIG. 4 (PRIOR ART)
FIG. 4 shows a hybrid channel ICD, which is part helical pathway and part slots, wherein the slots appear at intervals in the helical pathway.
Figure 5:
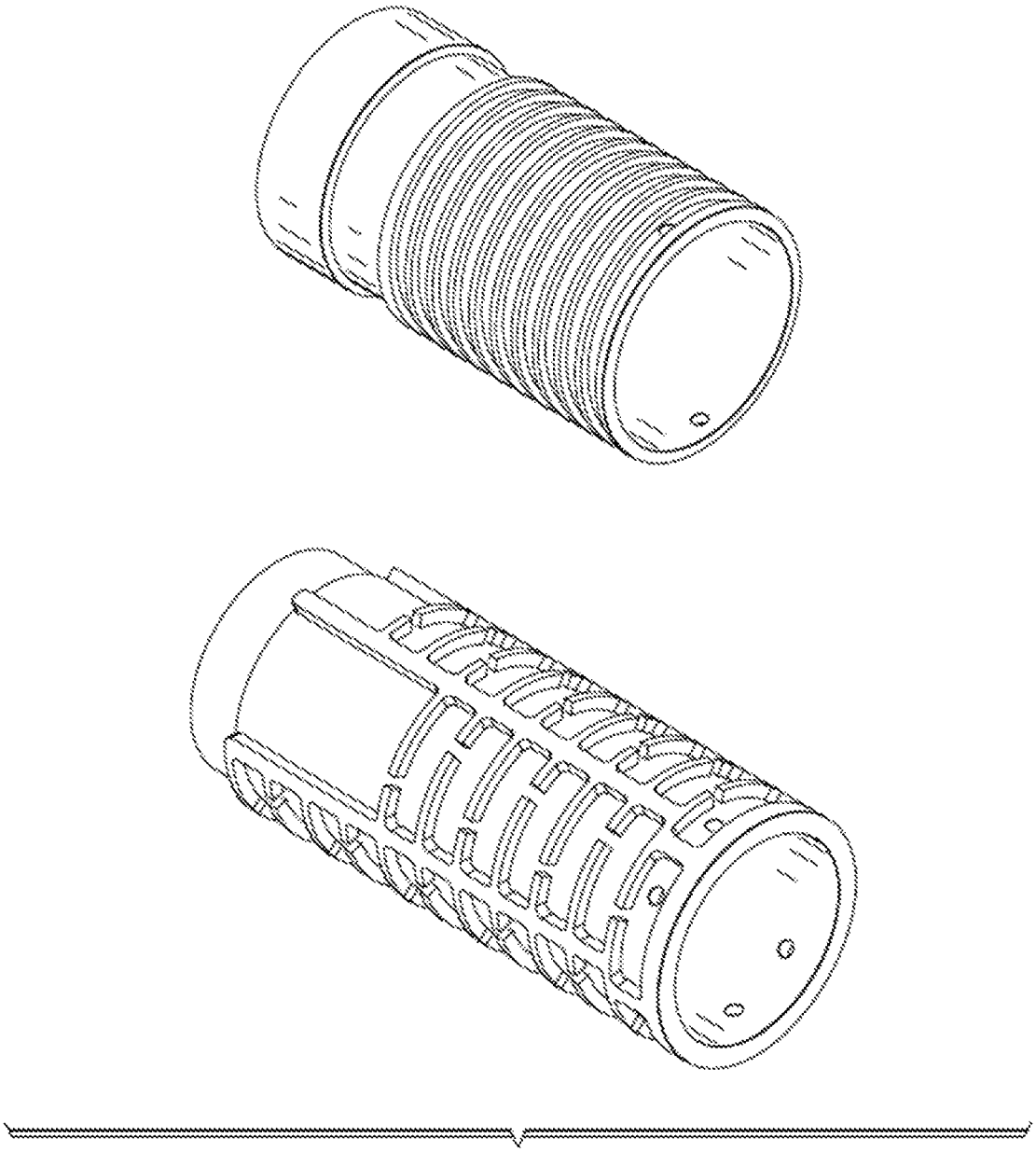
FIG. 5 (PRIOR ART)
FIG. 5 shows the commercially available Equalizer (a helical channel) and Equalizer Select flow patterns from Baker Hughes. The Select is a variation of a hybrid ICD.
Figure 6:
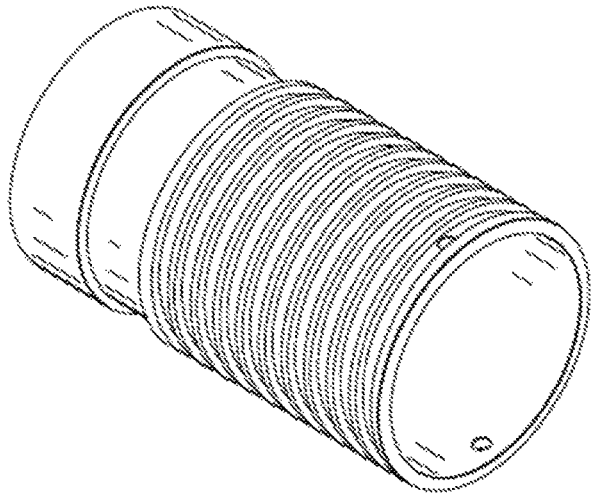
FIG. 6 (PRIOR ART)
FIG. 6 provides the flow equations for the helix and the Select.
Figure 6:
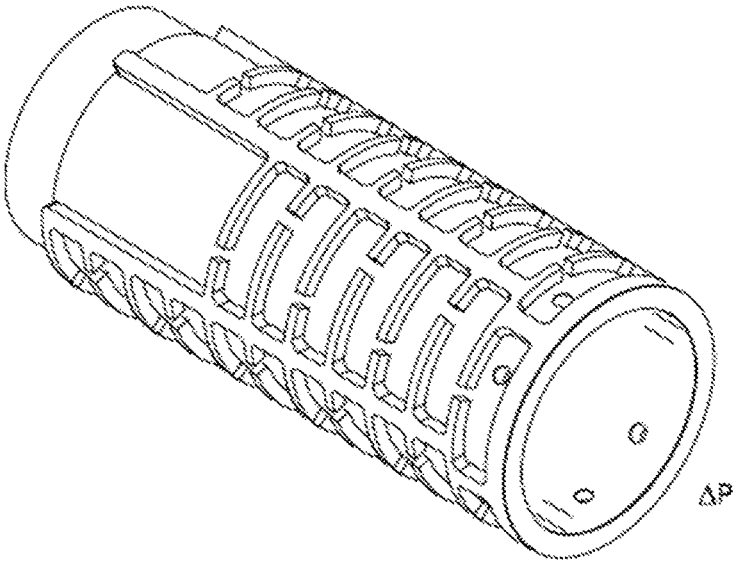
FIG. 6 (PRIOR ART)
Figure 7:
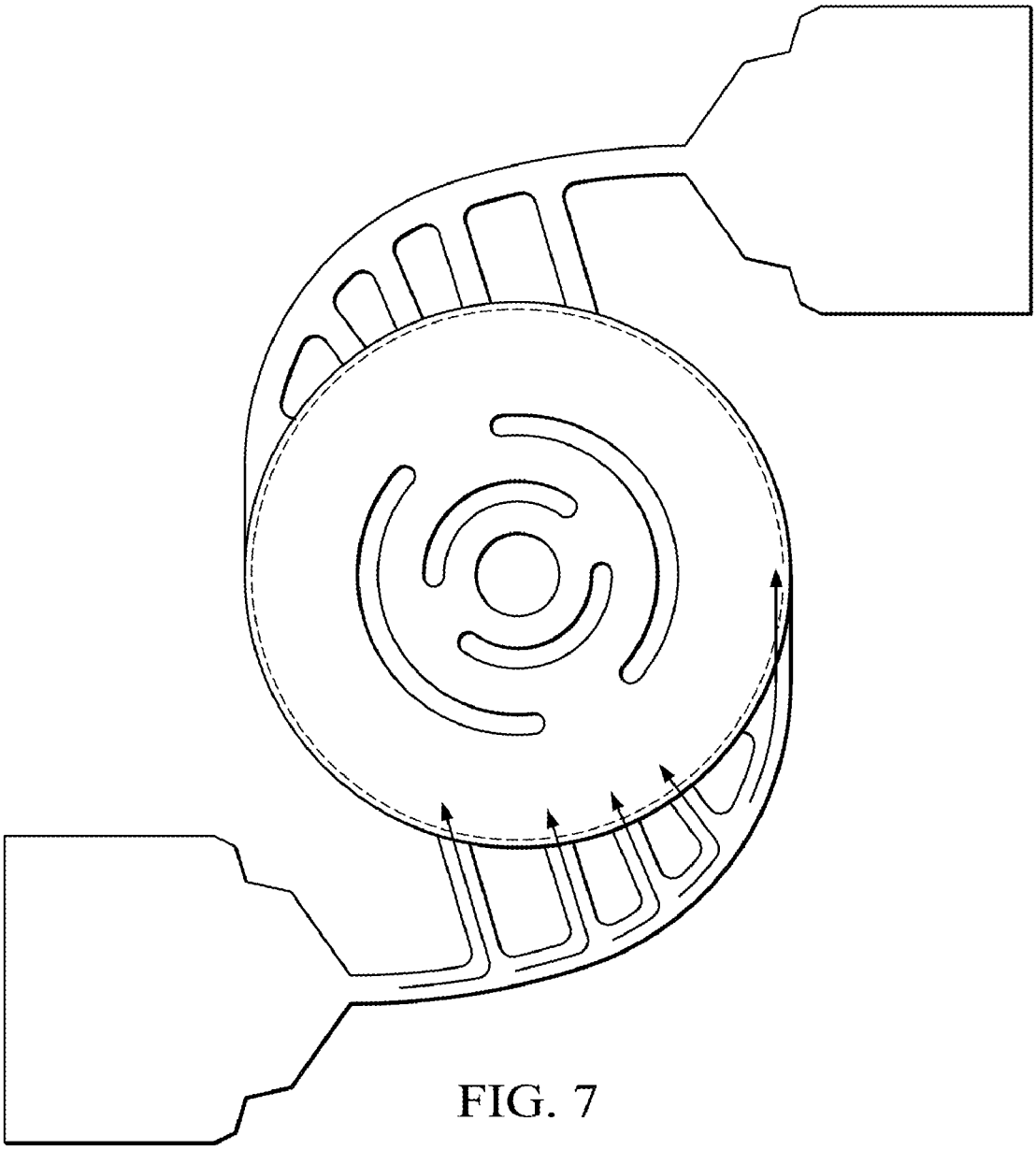
FIG. 7 shows a vortex-type autonomous ICD.
Figure 11:
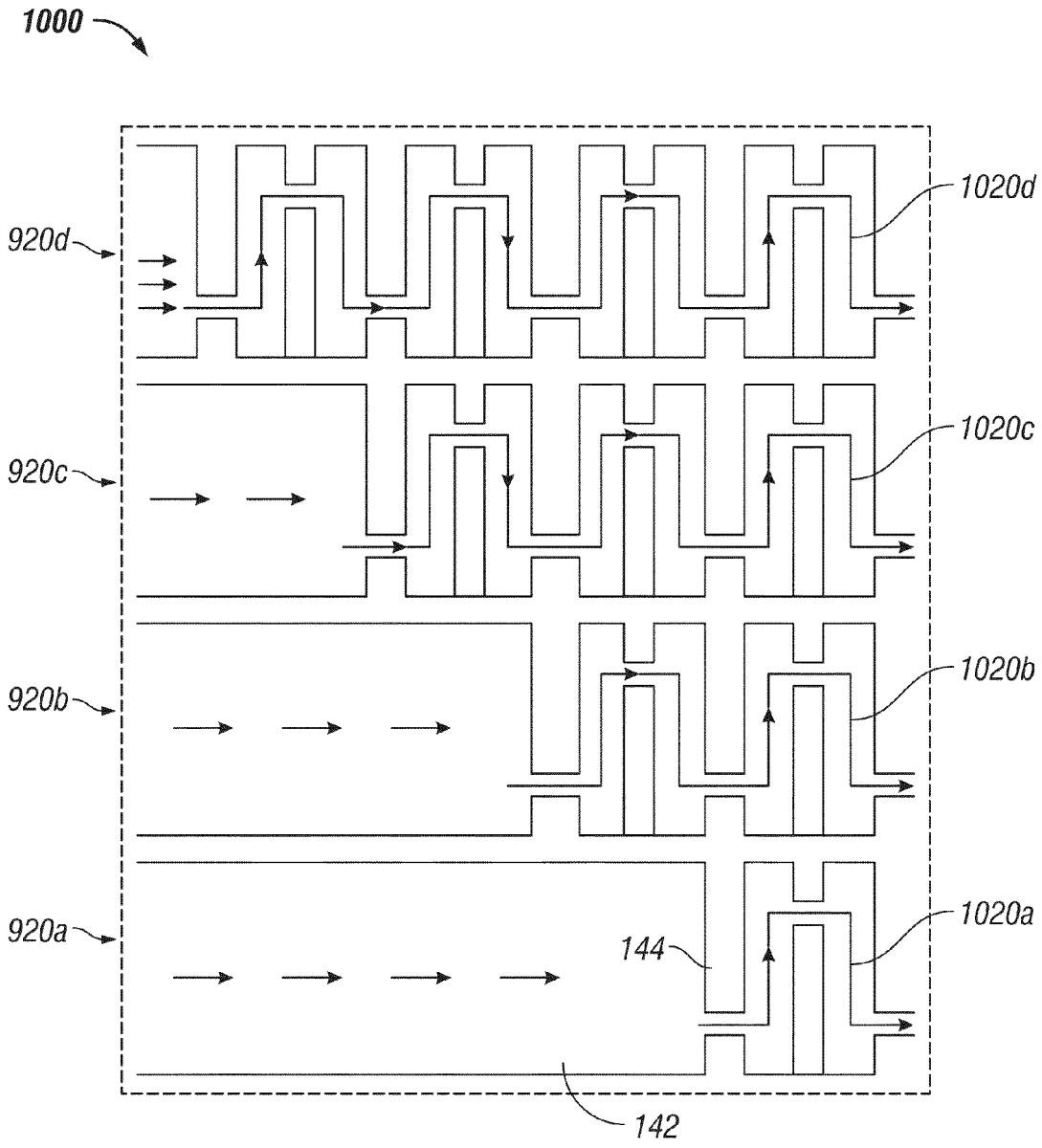
FIG. 11 shows the fluid flow paths for four illustrative channels.

The details of a Select type ICD are found in U.S. Pat.No.8,527,100 by Baker Hughes as shown in FIG. 11. FIG. 11 shows the fluid flow paths 142 for the four illustrative channels 920 *a*-920 *d* of the flow control device 1000. For ease of explanation, the flow control device 1000 is shown in phantom lines and "unwrapped" in order to better depict the channels 920 *a*-*d* in a flat plane, as opposed to the tubular depiction of FIG. 9. Each of these channels 920 *a*-9202 *d* provides a separate and independent flow path 142 between the annulus or formation and the tubular bore 402 (FIG. 4), as shown by flow paths 1020 *a*-1020 *d*. Also, in the embodiment shown, each of the channels 920 *a*-920 *d* provides a different pressure drop for a flowing fluid. The channel 920 *a* is constructed to provide the least amount of resistance to fluid flow and thus provides a relatively small pressure drop. The conduit 920 *d* is constructed to provide the greatest resistance to fluid flow and thus provides a relatively large pressure drop. The conduits 920 *b* and 920 *c* provide pressure drops in a range between those provided by the conduits 920 *a* and 920 *d*. Of course, two or more of the conduits may provide the same pressure drops or all of the conduits may provide the same pressure drop.

Fluid flow from any of the channels may be either partially or completely blocked with a sleeve having one or more ports, rotation of the sleeve controlling which pathway is active by virtue of the port being over a given pathway.

Thus, the fluid flow across the flow control device 1000 may be adjusted by selectively occluding one or more of the channels 920 *a*-920 *d*. The number of permutations for available pressure drops, of course, varies with the number of channels, which may be one or more as desired. Thus, in embodiments, the flow control device 1000 may provide a pressure drop associated with the flow across one channel 144, or a composite pressure drop associated with the flow across two or more channels. Such a device may be configured at the field and differently configured devices may be placed along the wellbore.

Additionally, in embodiments, some or all of the surfaces of the channels an ICD may be constructed to have a specific frictional resistance to flow. In some embodiments, the friction may be increased using textures, roughened surfaces, or other such surface features. Alternatively, friction may be reduced by using polished or smoothed surfaces. In other embodiments, the surfaces may be coated with a material that increases or decreases surface friction. Moreover, the coating may be configured to vary the friction based on the nature of the flowing material (e.g., water or oil). For example, the surface may be coated with a hydrophilic material that absorbs water to increase frictional resistance to water flow or a hydrophobic material that repels water to decrease frictional resistance to water flow. These In use, the novel ICDs are placed during completion as needed in either or both injection and productions wells. Typically, ICDs are placed wherever steam breakthrough is a problem, and where flow tends to be highest, e.g., at the heel. Use of ICDs all along the well serves to minimize breakthrough along its entire length.

ICDs are usually pre-configured on surface and after deployment it is not possible to adjust the chokes to alter the flow profile into the well unless a workover is performed where the completion is withdrawn from the well and replaced. When used in a steam injection well, ICDs are able to make more evenly distributed steam injection along the well bore. They are also beneficial in SAGD where steam breakthrough can present challenges and where flow parameters vary significantly between start-up and post start-up production. They can also be beneficial in any enhanced oil recovery method, such as CSS, SAGD, ES-SAGD and the like, where temperature and pressure may vary over time and/or where steam breakthrough is an issue.

The following references are incorporated by reference in their entirety for all purposes.

1. U.S. Pat. No. 8,527,100 Method of providing a flow control device that substantially reduces fluid flow between a formation and a wellbore when a selected property of the fluid is in a selected range.
2. SPE-153706 (2012) Stalder, Test of SAGD Flow Distribution Control Liner System, Surmont Field, Alberta, Canada
3. Zeng Q. et al., Comparative Study on Passive Inflow Control Devices by Numerical Simulation, Tech Science Press SL 9(3): 169-180 (2013), available online at techscience.com/doi/10.3970/s1.2013.009.169.pdf.
4. U.S. Ser. No. 62/216,672, filed Sep. 10, 2015, entitled ICD OPTIMIZATION by Guy Vachon.

What is claimed is:

1. A dual type inflow control device (dual-type ICD), comprising:

a) a tube and a sleeve fitting over said tube, said sleeve having at least one inlet, and said tube having at least one opening to an interior of said tube; and b) an annulus between said tube and said sleeve having a fluidic pathway therein from said inlet to said opening, said fluidic pathway having a first pattern and a second pattern different from said first pattern, said first and second patterns being fluidly connected in series or in parallel;

where said first pattern is helical channel and said second pattern is hybrid channel and wherein said helical channel fluidic pathway is optimized for a production phase of steam assisted gravity drainage (SAGD) and said hybrid channel fluidic pathway is optimized for a startup phase of SAGD.

2. A dual type inflow control device (dual-type ICD), comprising:

a) a tube and a sleeve fitting over said tube, said sleeve having at least one inlet, and said tube having at least one opening to an interior of said tube; and b) an annulus between said tube and said sleeve having a fluidic pathway therein from said inlet to said opening, said fluidic pathway having a first pattern and a second pattern different from said first pattern;

where said first and second patterns are arranged in series, and said first pattern is helical and said second pattern is hybrid channel and wherein said helical channel fluidic pathway is optimized for a production phase of SAGD and said hybrid channel fluidic pathway is optimized for a startup phase of SAGD.

3. A dual type inflow control device (dual-type ICD), comprising:

a) a tube and a sleeve fitting over said tube, said sleeve having at least one inlet, and said tube having at least one opening to an interior of said tube; and b) an annulus between said tube and said sleeve having a fluidic pathway therein from said inlet to said opening, said fluidic pathway having a first pattern and a second pattern different from said first pattern;

wherein said first and second patterns are arranged in series and flow through said first and second patterns is controlled with a temperature sensitive switch and wherein said first pattern is helical channel and is optimized for a production phase of SAGD and wherein said second pattern is hybrid channel and is optimized for a startup phase of SAGD.

4. A dual type inflow control device (dual-type ICD), comprising:

a) a tube and a sleeve fitting over said tube, said sleeve having at least one inlet, and said tube having at least one opening to an interior of said tube; and b) an annulus between said tube and said sleeve having a fluidic pathway therein from said inlet to said opening, said fluidic pathway having a first pattern and a second pattern different from said first pattern;

where said first and second patterns are arranged in parallel, and said first pattern is helical and said second pattern is hybrid channel and wherein said helical channel fluidic pathway is optimized for a production phase of SAGD and said hybrid channel fluidic pathway is optimized for a startup phase of SAGD.

5. A dual type inflow control device (dual-type ICD), comprising:

a) a tube and a sleeve fitting over said tube, said sleeve having at least one inlet, and said tube having at least one opening to an interior of said tube; and b) an annulus between said tube and said sleeve having a fluidic pathway therein from said inlet to said opening, said fluidic pathway having a first pattern and a second pattern different from said first pattern;

wherein said first and second patterns are arranged in parallel and flow through said first and second patterns is controlled with a temperature sensitive switch and wherein said first pattern is helical channel and is optimized for a production phase of SAGD and wherein said second pattern is hybrid channel and is optimized for a startup phase of SAGD.

6. A well configuration, comprising:

a well completed with a plurality of dual type ICDs of claim 1 or 2 or 3 or 4 or 5.

7. The well configuration of claim 6, wherein said well is a horizontal well.

8. The well configuration of claim 6, comprising a pair of wells, each well completed with more than one dual type inflow control device (dual-type ICD).

9. The well configuration of claim 8, wherein said pair of wells are horizontal wells.

10. A method of SAGD comprising:

a) providing a horizontal injection well above a horizontal production well, one or both wells completed with the dual type ICD of claim 1 or 2 or 3 or 4 or 5;

b) injecting steam into said injection well; and c) recovering mobilized oil from said production well.

11. The method of claim 10, further comprising recovering mobilized oil from said production well mostly via a first fluidic pathway during start up; and recovering mobilized oil from said production well mostly via a second fluidic pathway after start up.

12. An improved method of producing heavy oils by a steam based enhanced oil recovery method, wherein steam is injected into a well to mobilize oil and flow is controlled in said well with a plurality of ICDs, the improvement comprising:

providing a plurality of dual-type ICDs of claim 1 or 2 or 3 or 4 or 5 in said well, thus improving a cumulative steam to oil ratio (CSOR) of said well as compared to the same well with only single type ICDs.

* * * * *